US007438048B2

(12) United States Patent
Onobayashi et al.

(10) Patent No.: US 7,438,048 B2
(45) Date of Patent: Oct. 21, 2008

(54) FUEL INJECTION AMOUNT CONTROL APPARATUS FOR INTERNAL COMBUSTION ENGINE

(75) Inventors: Minoru Onobayashi, Tokai (JP); Hirokazu Konohara, Inazawa (JP); Nobuhiro Ogasawara, Nagoya (JP); Kunihiko Sato, Okazaki (JP)

(73) Assignees: Aisan Kogyo Kabushiki Kaisha, Obu (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/802,395

(22) Filed: May 22, 2007

(65) Prior Publication Data

US 2008/0077305 A1 Mar. 27, 2008

(30) Foreign Application Priority Data

May 29, 2006 (JP) ..... 2006-147665

(51) Int. Cl.
*F02D 31/00* (2006.01)
*F02M 51/00* (2006.01)

(52) U.S. Cl. ..... 123/352; 123/492

(58) Field of Classification Search ..... 123/357, 123/396, 352, 492, 676
See application file for complete search history.

(56) References Cited

U.S. PATENT DOCUMENTS 5,239,965 A * 8/1993 Ninomiya ..... 123/492
5,715,790 A * 2/1998 Tolley et al. ..... 123/396
6,549,840 B1 * 4/2003 Mikami et al. ..... 701/69
2001/0042535 A1 * 11/2001 Yamazaki et al. ..... 123/295

FOREIGN PATENT DOCUMENTS

| | | |
|---|---|---|
| JP | A 7-166918 | 6/1995 |
| JP | A 7-279711 | 10/1995 |
| JP | A 9-96234 | 4/1997 |
| JP | A 11-173197 | 6/1999 |

* cited by examiner

*Primary Examiner*—John T Kwon
(74) *Attorney, Agent, or Firm*—Oliff & Berridge, PLC

(57) ABSTRACT

An object is to prevent deterioration in both exhaust emission and fuel efficiency by suitably combining OTP boosting with power boosting. An electronic control unit (ECU) 30 of the present invention is arranged to control a fuel injection amount of an injector 7 to an engine 1 according to an operating condition of the engine 1, and perform OTP boosting of the fuel injection amount to prevent overheating of a discharge passage 3 and a catalyst converter 11 when the engine 1 comes into a high load and high rotation operating condition and perform power boosting that increases the fuel injection amount to enrich an air-fuel ratio to an output air-fuel ratio when the engine 1 comes into a high load operating condition. The ECU 30 executes the power boosting when the engine 1 comes into the high load and high rotation operating condition and executes the OTP boosting later from the start of the power boosting, delayed by a period attributable to at least an increased amount of fuel by the power boosting.

6 Claims, 7 Drawing Sheets

FUEL INJECTION AMOUNT CONTROL APPARATUS FOR INTERNAL COMBUSTION ENGINE

BACKGROUND OF THE INVENTION

1. Field of the Invention

This invention relates to a fuel injection amount control apparatus that controls a fuel injection amount to be supplied to an internal combustion engine according to operating conditions. Particularly, the invention relates to a fuel injection amount control apparatus for an internal combustion engine arranged to perform OTP boosting of a fuel injection amount to prevent overheating of a catalyst or the like during high load and high rotation engine operation and to perform power boosting of a fuel injection amount to enrich an air-fuel ratio to an output air-fuel ratio during high load engine operation.

2. Description of Related Art

For control of the fuel injection amount for an internal combination engine, boosting for Over Temperature Protection (OTP) and power boosting have conventionally been applied to correct the fuel injection amount according to the operating condition of the internal combination engine. OTP boosting is generally a boost correction that is performed to prevent overheating of a catalyst or the like for detoxifying exhaust gas provided in an exhaust passage during high load and high rotation operation of the internal combustion engine. By boosting the fuel injection amount and enriching the air-fuel ratio, the OTP boosting can decrease the exhaust gas temperature and suppress a rise of the catalyst temperature. On the other hand, power boosting is generally capable of enriching the air-fuel ratio to make up for output shortage during high load operation (e.g., full-throttle acceleration) of the internal combustion engine.

A fuel injection control apparatus for an internal combustion engine, which is described, for example, in Jpn. unexamined patent publication No. 7(1995)-166918, is adapted to perform OTP boosting to prevent overheating of an exhaust system including a catalyst. This apparatus is also adapted to determine whether the catalyst is active by estimating the catalyst temperature using an integration value of intake air amount and arranged not to perform OTP boosting when the catalyst becomes not more than an active temperature at cold start or the like. This apparatus can estimate the catalyst temperature and therefore has a merit of dispensing with a catalyst temperature sensor.

On the other hand, an acceleration control apparatus, which is described, for example, in Jpn. unexamined patent publication No. 9(1997)-96234, carries out power boosting (enrich control). In particular, this apparatus is adapted to perform enrich delay control that is arranged to start enrich control for power boosting after the elapse of a certain period of time after enrich control conditions are fulfilled during acceleration of an internal combustion engine. The apparatus is also adapted to stop the enrich delay control and start enrich control, when the catalyst temperature detected by a sensor exceeds a predetermined temperature during the enrich delay control.

Here, for example, it is conceivable to control the fuel injection by combining the above-mentioned OTP boosting based on the estimated catalyst temperature with the above-mentioned power boosting during high load operation.

BRIEF SUMMARY OF THE INVENTION

However, in such a manner of fuel injection control by simply combining the OTP boosting with the power boosting, both the OTP boosting and the power boosting may take effect at the same time. Thereby, the fuel injection amount may be oversupplied, which might deteriorate exhaust emission (especially, CO) or lower fuel efficiency. Since the power boosting also enriches the air-fuel ratio, thus producing the effect of decreasing the exhaust gas temperature and suppressing a rise of the catalysis temperature, if both the OTP boosting and the power boosting take effect at the same time, the fuel used for the OTP boosting will be wasted.

The present invention has been contrived in view of the above matters and has an object to provide a fuel injection amount control apparatus for an internal combustion engine adapted to be capable of preventing both exhaust emission and fuel efficiency from being deteriorated by suitably combining the OTP boosting with the power boosting.

To achieve the above object, the present invention provides a fuel injection amount control apparatus for internal combustion engine, including fuel injection amount control means arranged to control a fuel injection amount of fuel injection means to the internal combustion engine according to an operating condition of the internal combustion engine, perform OTP boosting that increases the fuel injection amount in order to prevent overheating of an exhaust system when the internal combustion engine comes into a first given operating condition, and execute power boosting that increases the fuel injection amount in order to enrich an air-fuel ratio to an output air-fuel ratio when the internal combustion engine comes into a second given operating condition, and wherein the apparatus includes boost timing adjustment means arranged to cause the injection amount control means to perform the power boosting and arranged to execute the OTP boosting later from start of the power boosting, delayed by a period attributable to at least an increased amount of fuel by the power boosting, when the internal combustion engine comes into the first given operating condition and the second given operating condition.

According to the aforementioned aspect of the invention, the injection amount control means controls the amount of fuel injection by the fuel injection means into the internal combustion engine, according to the operating condition of the internal combustion engine. Here, when the internal combustion engine comes into the first given operating condition, the injection amount control means performs OTP boosting that increases the fuel injection amount to prevent overheating of the exhaust system. When the internal combustion engine comes into the second given operating condition, the injection amount control means performs power boosting that increases the fuel injection amount to enrich the air-fuel ratio to an output air-fuel ratio. Here, the first given operating condition in which OTP boosting is performed can be assumed to be, for example, a condition where the internal combustion engine runs in high rotation and under high load. The second given operating condition in which power boosting is performed can be assumed to be, for example, a condition where the internal combustion engine runs under high load. Therefore, in this case, when the internal combustion engine runs in low or medium rotation under high load, power boosting may be performed, but OTP boosting is not performed. When the internal combustion engine runs in high rotation under high load, both OTP boosting and power boosting may be performed. Thus, when the internal combustion engine comes into the first given operating condition and the second given operating condition, the boost timing adjustment means causes the injection amount control means to perform power boosting and to execute OTP boosting later from the start of the power boosting, delayed by a period attributable to at least an increased amount of fuel by the power boosting. Therefore, when the internal combustion engine runs in the first given operating condition and the second given operating condition, it is avoided that both power boosting and OTP boosting take effect at the same time longer than necessary.

According to the present invention, it is therefore possible to increase the fuel injection amount by suitably combining OTP boosting with power boosting and prevent both exhaust emission and fuel efficiency from being deteriorated.

According to another aspect, furthermore, the present invention provides a fuel injection amount control apparatus for internal combustion engine, including fuel injection amount control means arranged to control a fuel injection amount of fuel injection means to the internal combustion engine according to an operating condition of the internal combustion engine, perform OTP boosting that increases the fuel injection amount in order to prevent overheating of an exhaust system including a catalyst when the internal combustion engine comes into a first given operating condition, and execute power boosting that increases the fuel injection amount in order to enrich an air-fuel ratio to an output air-fuel ratio when the internal combustion engine comes into a second given operating condition, and wherein the apparatus includes: temperature estimation means which estimates the temperature of the catalyst based on the operating condition of the internal combustion engine and, when the power boosting is performed, estimates the catalyst temperature lower than when the power boosting is not performed, the injection amount control means being arranged to perform the OTP boosting when the power boosting is not performed and the estimated catalyst temperature is equal to or more than a predetermined value, and boost timing adjustment means arranged to cause the injection amount control means, when the internal combustion engine comes into the first given operating condition and the second given operating condition, to perform power boosting and to execute OTP boosting when the catalyst temperature estimated lower is equal to or more than the predetermined value.

According to the aforementioned aspect of the invention, the injection amount control means controls the amount of fuel injection by the fuel injection means into the internal combustion engine, according to the operating condition of the internal combustion engine. Here, when the internal combustion engine comes into the first given operating condition, the injection amount control means performs OTP boosting that increases the fuel injection amount to prevent overheating of the exhaust system including a catalyst. When the internal combustion engine comes into the second given operating condition, the injection amount control means performs power boosting that increases the fuel injection amount to enrich the air-fuel ratio to an output air-fuel ratio. Here, the first given operating condition in which OTP boosting is performed can be assumed to be, for example, the condition where the internal combustion engine runs in high rotation under high load. The second given operating condition in which power boosting is performed can be assumed to be, for example, the condition where the internal combustion engine runs under high load. Therefore, in this case, when the internal combustion engine runs in low or medium rotation under high load, power boosting may be performed, but OTP boosting is not performed. When the internal combustion engine runs in high rotation under high load, both OTP boosting and power boosting may be performed.

Meanwhile, the temperature estimation means estimates the catalyst temperature based on the operating condition of the internal combustion engine and, particularly when power boosting is performed, estimates the catalyst temperature lower than when power boosting is not performed. Here, when power boosting is not performed, the injection amount control means performs OTP boosting when the normally estimated catalyst temperature is equal to or more than a predetermined value. When the internal combustion engine runs in the first given operating condition and the second given operating condition, the boost timing adjustment means causes the injection amount control means to perform power boosting and to execute OTP boosting when the catalyst temperature estimated lower than the normal estimation is equal to or more than a predetermined value. Therefore, when the internal combustion engine runs in the first given operating condition and the second given operating condition, after the power boosting is performed, the OTP boosting is performed when the catalyst temperature estimated lower than the normal estimation is equal to or more than the predetermined value, and the OTP boosting is performed later than normal, delayed from the start of the power boosting. It is thus avoided that both power boosting and OTP boosting take effect at the same time longer than necessary. Because the OTP boosting is performed when the catalyst temperature estimated based on the operating condition of the internal combustion engine is equal to or more than the predetermined value, the timing to start OTP boosting changes depending on the operating condition.

According to the present invention, it is therefore possible to increase the fuel injection amount by suitably combining OTP boosting with power boosting and prevent both exhaust emission and fuel efficiency from being deteriorated. It is also possible to perform OTP boosting at a proper timing for the operating condition of the internal combustion engine.

DETAILED DESCRIPTION OF THE PREFERRED EMBODIMENTS

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

A detailed description of a preferred embodiment of a fuel injection amount control apparatus for an internal combustion engine embodying the present invention will now be given referring to the accompanying drawings.

Figure 1:
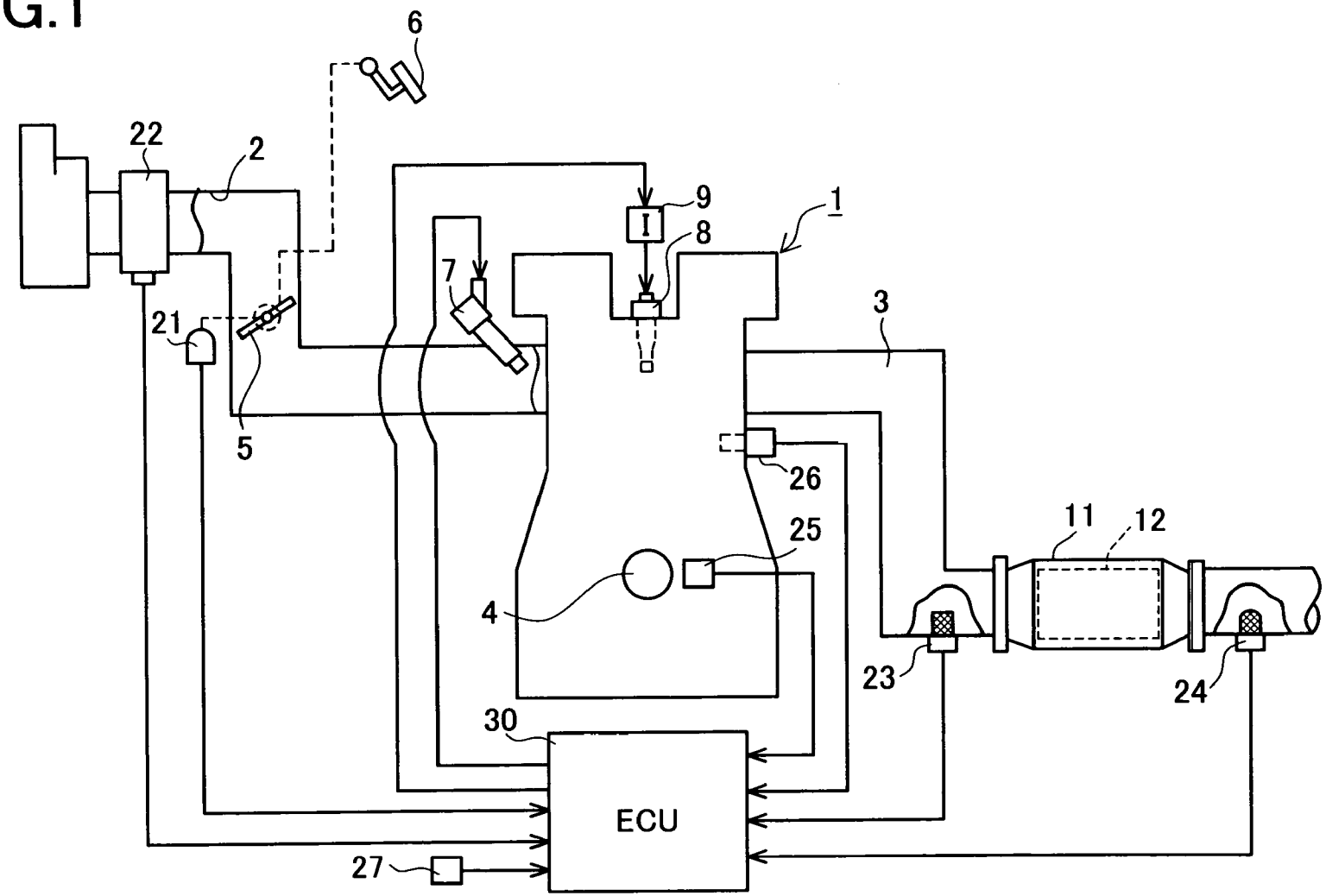
FIG. 1 is a simplified structure diagram of an engine system.

FIG. 1 shows a simplified structure diagram of an engine system mounted on a motor vehicle, including a fuel injection amount control apparatus for an internal combustion engine. A multicylindered internal combustion engine (an engine) 1 having a known structure is arranged to explode and burn a combustible gas mixture supplied through an intake passage 2 in a combustion chamber of each cylinder and discharge an exhaust gas produced after the combustion through an exhaust passage 3, thereby moving a piston (not shown), rotating a crank shaft 4, and gaining power.

A throttle valve 5 placed in the intake passage 2 is opened and closed to adjust the amount of air (intake air quantity) QA that is allowed to flow through this passage 2 and sucked into each cylinder. This valve 5 is operated in linkage with the operation of an accelerator pedal 6 provided in the vicinity of a driver's seat. A throttle sensor 21 installed near the throttle valve 5 detects the degree of opening of this valve 5 (throttle opening degree) TA and outputs an electrical signal representing its detected value. An air flow meter 22 installed in the intake passage 2 measures the intake air quantity QA flowing through the intake passage 2 and outputs an electrical signal representing its measured value.

A fuel injection valve (an injector) 7 installed for each cylinder injects fuel into an intake port of each cylinder. To each injector 7, fuel is pumped and delivered by a fuel supply device (not shown) consisting of a fuel tank, a fuel pump, and fuel piping or the like. Each injector 7 corresponds to the fuel injection means of the present invention.

A spark plug 8 mounted in each cylinder on the engine 1 ignites the fuel with a high voltage output from an igniter 9. The timing of ignition of each spark plug 8 is determined by the timing of high voltage output by the igniter 9.

A catalytic converter 11 installed in the exhaust passage 3 incorporates a three-way catalyst 12 for cleaning or detoxifying the exhaust gas discharged from the engine 1. As is commonly known, the three-way catalyst 12 oxidizes carbon monoxide (CO) and carbon hydride (HC) and reduces nitrogen oxide (NOx) simultaneously. Thereby, three poisonous components (CO, HC, NOx) of the exhaust gas are detoxified to nontoxic gases of carbon dioxide ($CO_2$), water vapor ($H_2O$), and nitrogen ($N_2$). The exhaust gas detoxifying characteristic of the three-way catalyst 12 greatly depends on air-fuel ratio setting of the engine 1. That is, when the air-fuel ratio is dilute (lean), the amount of oxygen ($O_2$) after combustion becomes larger and oxidation becomes more active and reduction becomes rather inactive. When the oxidation and reduction are well balanced (approximating to a theoretical air-fuel ratio), the three-way catalyst 12 works most effectively. In the present embodiment, the exhaust passage 3 and the catalytic converter 11 constitute an exhaust system of the present invention.

In the exhaust passage 3, an air-fuel ratio sensor 23 is placed upstream from the three-way catalyst 12 and an oxygen sensor 24 is placed downstream from the three-way catalyst 12. The air-fuel ratio sensor 23 detects an oxygen density Ox, as a current value, in the exhaust gas discharged from the engine 1 to the exhaust passage 3 and converts the current value into a voltage value, thus detecting the air-fuel ratio. The oxygen sensor 24 detects an oxygen density Ox in the exhaust gas passed through the three-way catalyst 12 and outputs an electrical signal representing its detected value.

A rotational speed sensor 25 installed on the engine 1 detects the angular velocity of the crank shaft 4, that is, engine rotational speed NE, and outputs an electrical signal representing its detected value. A water temperature sensor 26 installed on the engine 1 detects the temperature of cooling water ("cooling water temperature") THW flowing inside the engine 1 and outputs an electrical signal representing its detected value. A vehicle speed sensor 27 installed on the vehicle detects the running speed of the vehicle ("vehicle speed") SPD and outputs an electrical signal representing its detected value.

In the present embodiment, the above throttle sensor 21, air flow meter 22, air-fuel ratio sensor 23, oxygen sensor 24, rotational speed sensor 25, water temperature sensor 26, and vehicle speed sensor 27 constitute an operating condition detecting means for detecting operating conditions of the engine 1 or the vehicle.

In the present embodiment, an electronic control unit (ECU) 30 receives various kinds of signals which are output from the throttle sensor 21, air flow meter 22, air-fuel ratio sensor 23, oxygen sensor 24, rotational speed sensor 25, water temperature sensor 26, and vehicle speed sensor 27. Based on these received signals, the ECU 30 performs fuel injection control including air-fuel ratio control, fuel injection amount control, and fuel injection timing control and ignition timing control, and controls each injector 7 and igniter 9.

Here, the fuel injection control is to control the amount and timing of fuel injection by controlling each injector 7 according to the operating condition of the engine 1. The air-fuel ratio control is feedback control to correct the air-fuel ratio of the engine 1 to a predetermined air-fuel ratio such as a theoretical air-fuel ratio by controlling the injector 7 based on a signal output from at least the air-fuel ratio sensor 23. The ignition timing control is to control the timing of ignition by each spark plug 8 by controlling the igniter 9 according to the operating condition of the engine 1.

In the present embodiment, the ECU 30 corresponds to the injection amount control means, the boost timing adjustment means, and the temperature estimation means of the present invention. The ECU 30 has a well-known structure comprising a central processing unit (CPU), a read only memory (ROM), a random access memory (RAM), a backup RAM, and other components. The ROM previously stores prearranged control programs for implementing the above control functions. The ECU (CPU) 30 executes the above control functions according to these control programs.

Figure 2:
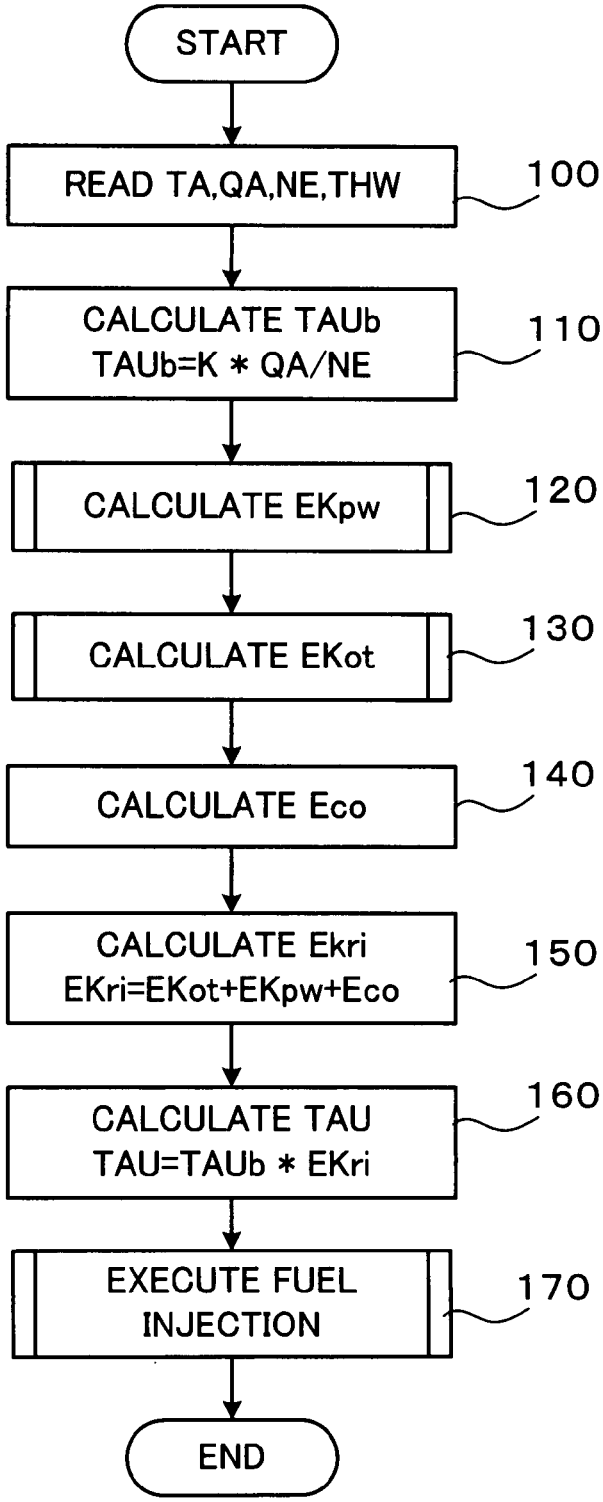
FIG. 2 is a flowchart of processes of fuel injection amount control.
Figure 3:
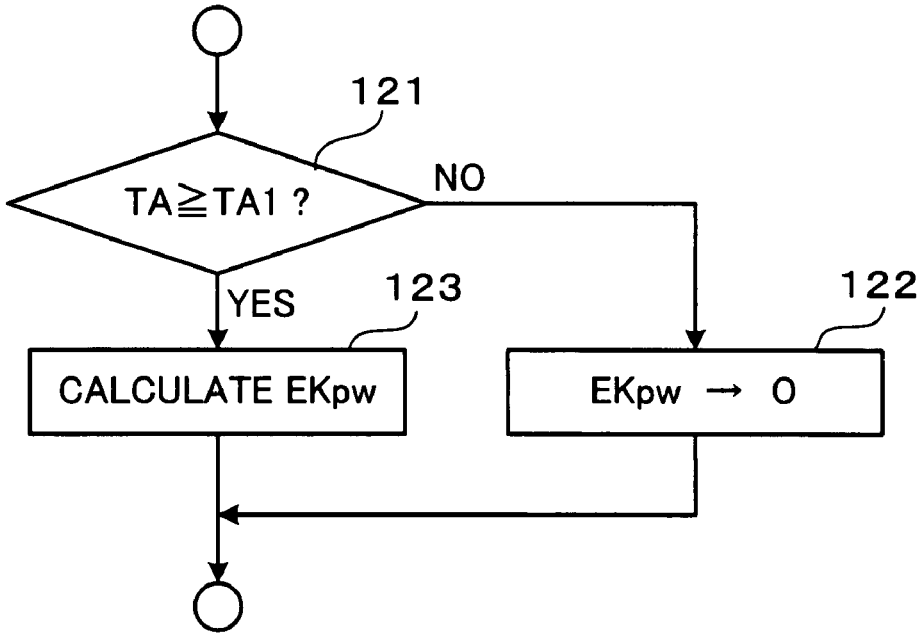
FIG. 3 is a flowchart of a process of calculating a corrected power boost value.
Figure 4:
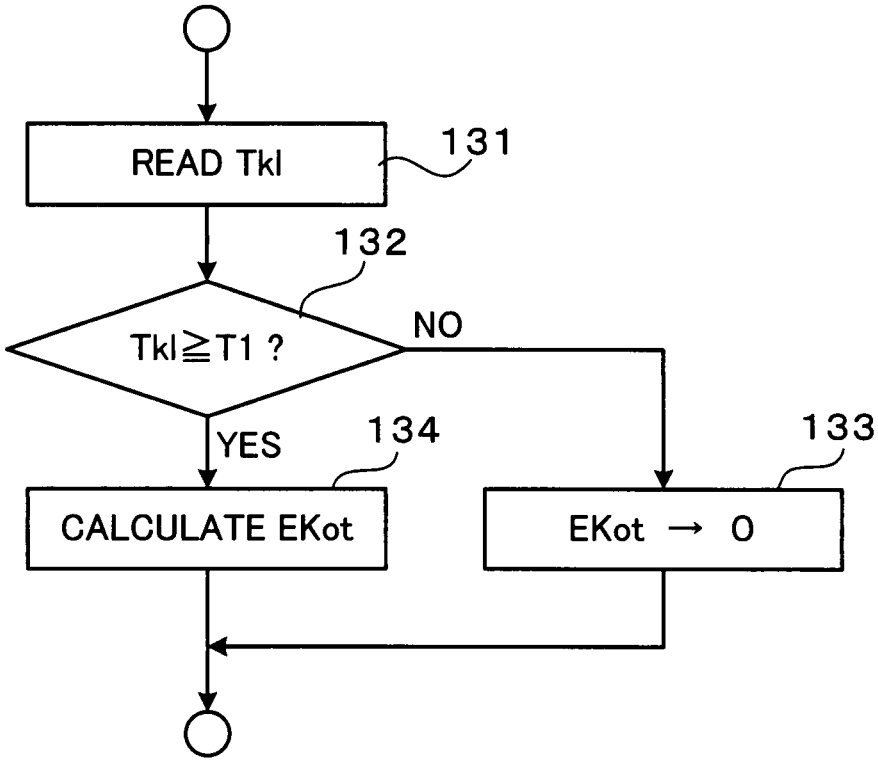
FIG. 4 is a flowchart of a process of calculating a corrected OTP boost value.
Figure 5:
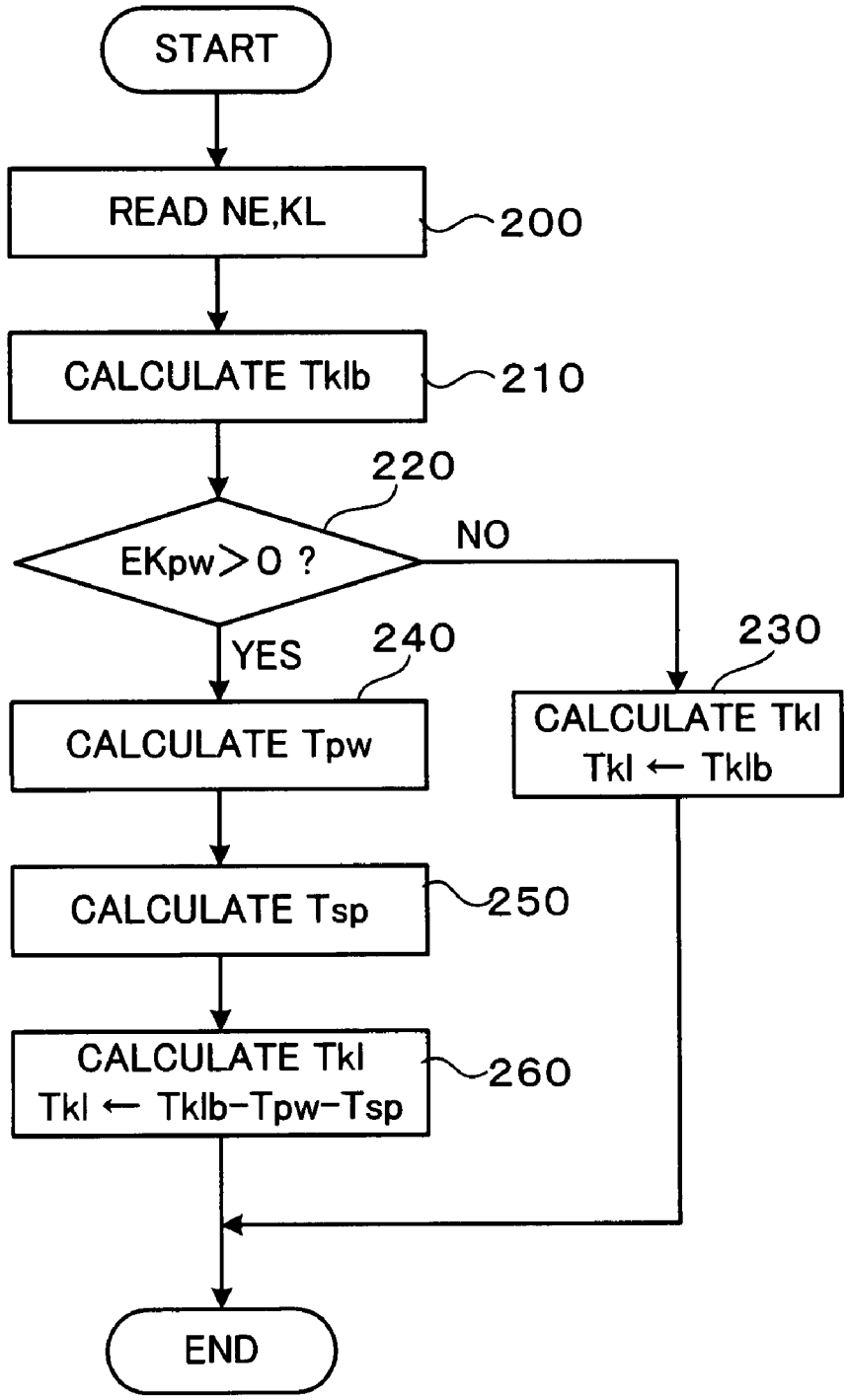
FIG. 5 is a flowchart of a process of calculating an estimated catalyst temperature.
Figure 6:
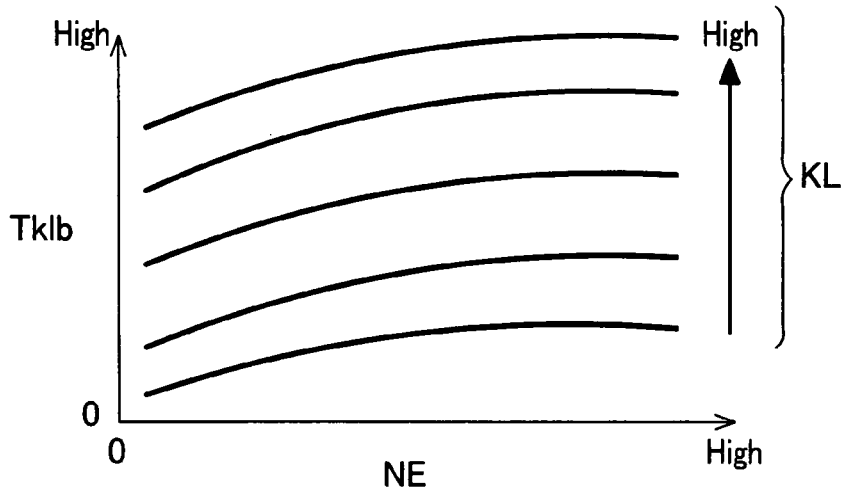
FIG. 6 is a graph showing function data which is referred to for calculation of a basic estimated catalyst temperature.
Figure 7:
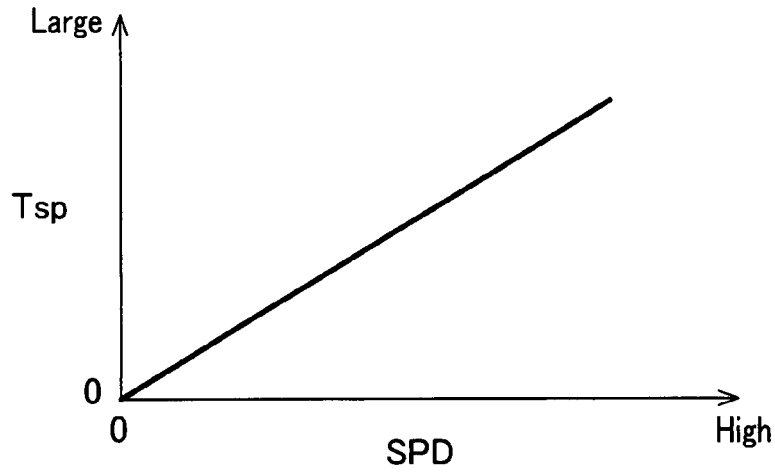
FIG. 7 is a graph showing function data which is referred to for calculation of a temperature decrease value proportional to vehicle speed.

Next, the fuel injection amount control process to be executed by the ECU 30 is explained with reference to FIGS. 2 to 7. FIG. 2 shows a flowchart of the fuel injection amount control process (a main routine). FIG. 3 shows a flowchart of a process of calculating a corrected power boost value EKp. FIG. 4 shows a flowchart of a process of calculating a corrected OTP boost value EKot. FIG. 5 shows a flowchart of a process of calculating an estimated catalyst temperature Tkl. The ECU 30 periodically executes the above main routine at intervals of a predetermined time.

During operation of the engine 1, at step 100, the ECU 30 reads-in the throttle opening degree TA detected by the throttle sensor 21, the intake air quantity QA measured by the air flow meter 22, the engine rotational speed NE detected by the rotational speed sensor 25, and the cooling water temperature THW detected by the water temperature sensor 26.

At step 110, the ECU 30 calculates a basic fuel injection amount TAUb at the current point of time, based on the intake air quantity QA and the engine rotational speed NE which have been read-in. The ECU 30 calculates the basic fuel injection amount TAUb according to the following equation (1). In this equation (1), "K" denotes a given constant of proportion. This basic fuel injection amount TAUb denotes a basic value for calculating an ultimate fuel injection amount TAU.

$$TAUb=K*QA/NE \quad (1)$$

At step 120, the ECU 30 calculates a corrected power boost value EKpw for performing power boosting. The corrected power boost value EKpw denotes a correction term of boosting of the fuel injection amount TAU to enrich the combustible gas mixture which is supplied to the engine 1 to an output air-fuel ratio, when the engine 1 comes into a second given operating condition as stated in the present invention, e.g., a high load operating condition. The ECU 30 calculates this corrected value EKpw according to a subroutine which is shown in FIG. 3.

Referring to FIG. 3, at step 121, the ECU 30 determines whether the throttle opening degree TA detected by the throttle sensor 21 is equal to or more than a predetermined criterion value TA1 above which high load running takes place. Here, the criterion value TA1 can be assumed to be, for example, "70%" (if full opening of the throttle opening degree TA is 100%). If the result of this determination is "NO", the ECU 30 sets the corrected power boost value EKpw to "0" at step 122. That is, this disables the power boosting. Otherwise, if the result of the above determination is "YES", the ECU 30 calculates the corrected power boost value EKpw at step 123. The ECU 30 calculates this corrected value EKpw, for example, by referring to function data (map) which has been set in advance with regard to the parameters of engine rotational speed NE and corrected value EKpw. Here, when the engine 1 comes into a high load operating condition, that is, when the throttle opening degree TA becomes equal to or more than the predetermined criterion value TA1, a particular value of the corrected power boost value EKpw is calculated in order to perform power boosting that increases the fuel injection amount TAU to enrich the air-fuel ratio A/F of the engine 1 to an output air-fuel ratio which leads to a rise in engine output.

Returning to the main routine of FIG. 2, at step 130, the ECU 30 calculates a corrected OTP boost value EKot for performing OTP boosting. The OTP boosting denotes a correction term of boosting of the fuel injection amount TAU to prevent overheating of the exhaust system including the exhaust passage 3 and the catalytic converter 11, when the engine 1 comes into the first given operating condition as stated in the present invention, e.g., an operating condition of high load and high rotation. The ECU 30 calculates this corrected value EKot according to a subroutine which is shown in FIG. 4.

Referring to FIG. 4, at step 131, the ECU 30 reads-in the estimated catalyst temperature Tkl. The estimated catalyst temperature Tkl denotes the temperature of the three-way catalyst 12 estimated based on the operating condition of the engine 1 according to another routine. Detail on calculating this estimated catalyst temperature Tkl will be described later. Then, at step 132, the ECU 30 determines whether the estimated catalyst temperature Tkl is equal to or more than a predetermined setting value T1. Here, the predetermined setting value T1 can be assumed to be, for example, "950° C.". If the result of the above determination is "NO", the ECU 30 sets the corrected OTP boost value EKot to "0" at step 133. That is, this disables the OTP boosting. Otherwise, if the result of the above determination is "YES", the ECU 30 calculates the corrected OTP boost value EKot at step 134. The ECU 30 calculates this corrected value EKot, for example, by referring to function data (map) which has been set in advance with regard to the parameters of engine rotational speed NE, engine load KL, and corrected value EKot based on the engine rotational speed NE, the intake air quantity QA, and the throttle opening degree TA. Here, when the engine 1 comes into an operating condition of high load and high rotation, that is, at timing when the estimated catalyst temperature Tkl becomes equal to or more than the predetermined setting value T1, a particular value of the corrected OTP boost value EKot is obtained in order to perform OTP boosting that increases the fuel injection amount TAU to prevent overheating of the exhaust system.

Here, calculating the above estimated catalyst temperature Tkl is explained with reference to a flowchart of FIG. 5. First, at step 200, the ECU 30 reads-in the engine rotational speed NE and the engine load KL. The engine load KL is calculated based on the engine rotational speed NE, intake air quantity QA, and throttle opening degree TA, and the engine load KL denotes a load condition of the engine 1.

At step 210, the ECU 30 calculates a basic estimated catalyst temperature Tklb. The ECU 30 calculates this basic estimated catalyst temperature Tklb, for example, by referring to function data (map), such as a graph shown in FIG. 6, which has been set in advance with regard to the parameters of engine rotational speed NE, engine load KL, and basic estimated catalyst temperature Tklb. Thus, the basic estimated catalyst temperature Tklb is calculated depending on the operating condition of the engine 1, particularly, depending on the engine rotational speed NE and the engine load KL. At step 220, the ECU 30 determines whether the corrected power boost value EKpw is greater than "0", that is, whether the power boosting has been carried out. If the result of this determination is "NO", the ECU 30 takes the above calculated basic estimated catalyst temperature Tklb as an ultimate estimated catalyst temperature Tkl at step 230.

Otherwise, if the result of the determination at step 220 is "YES", the ECU 30 calculates a temperature decrease value Tpw attributable to an increased amount of fuel by the power boosting. That is, the ECU 30 calculates this temperature decrease value Tpw by referring to function data (map) which has been set in advance with regard to the parameters of corrected power boost value EKpw and temperature decrease value Tpw.

Further, at step 250, the ECU 30 calculates a temperature decrease value Tsp proportional to the vehicle speed. The ECU 30 calculates this temperature decrease value Tsp, for example, by referring to function data (map), such as a graph shown in FIG. 7, which has been set in advance with regard to the parameters of vehicle speed SPD and temperature decrease value Tsp.

Then, at step 260, the ECU 30 calculates an ultimate estimated catalyst temperature Tkl by subtracting the temperature decrease value Tpw attributable to an increased amount of fuel by the power boosting and the temperature decrease value Tsp proportional to the vehicle speed, calculated as above, from the basic estimated catalyst temperature Tklb calculated as above. Thus, when the power boosting is performed, the ECU 30 evaluates the estimated catalyst temperature Tkl that is decreased by the temperature decrease depending on an increased amount of fuel by the power boosting and the temperature decrease depending on the vehicle speed SPD.

Returning to the main routine of FIG. 2, at step 140, the ECU 30 calculates a corrected cold boost value Eco for cold boosting. This cold boosting denotes a correction term of boosting of the fuel injection amount TAU to facilitate warming of the engine 1 during a cold state. The ECU 30 calculates this corrected value Eco by referring to function data (map)

which has been set in advance with regard to the parameters of cooling water temperature THW and corrected cold boost value Eco.

Then, at step 150, the ECU 30 calculates a total corrected boost value EKri. The ECU 30 calculates the total corrected boost value EKri by summing up the corrected OTP boost value EKot, corrected power boost value EKpw, and corrected cold boost value Eco, calculated as above. That is, the ECU 30 calculates the total corrected boost value EKri according to the following equation (2):

$$EKri=EKot+EKpw+Eco \quad (2)$$

After that, at step 160, the ECU 30 calculates an ultimate fuel injection amount TAU by multiplying the basic fuel injection amount TAUb by the total corrected boost value EKri. That is, the ECU 30 calculates the fuel injection amount TAU according to the following equation (3). This fuel injection amount TAU denotes a required value of fuel amount to be injected by the injector 7 for one injection of fuel.

$$TAU=TAUb*EKri \quad (3)$$

Then, at step 170, the ECU 30 controls the injector 7 to give fuel injection according to the calculated fuel injection amount TAU. The ECU 30 opens the injector 7 at a timing determined according to the operating condition of the engine 1 to give one injection of fuel.

As described above, according to the fuel injection amount control apparatus of the present embodiment, the ECU 30 controls the fuel injection amount TAU to be injected from the injector 7 for supply to the engine 1, according to the operating condition of the engine 1. Here, when the engine 1 comes into the high load and high rotation operating condition, the ECU 30 performs OTP boosting that increases the fuel injection amount TAU to prevent overheating of the catalytic converter 11 including the three-way catalyst 12 and the exhaust passage 3. When the engine 1 comes into the high load operating condition such as when full-throttle acceleration is performed, the ECU 30 performs power boosting that increases the fuel injection amount TAU to enrich the air-fuel ratio of the engine 1 to an output air-fuel ratio. Therefore, when the engine 1 runs in low or medium rotation under high load, the power boosting is performed, but the OTP boosting is not performed. When the engine 1 runs in high rotation under high load, both the OTP boosting and the power boosting are performed in parallel.

Meanwhile, the ECU 30 evaluates the estimated catalyst temperature Tkl based on the operating condition of the engine 1, that is, the engine rotational speed NE and the engine load KL. In particular, when the power boosting is performed, the ECU 30 evaluates the estimated catalyst temperature Tkl that is decreased, lower than when the power boosting is not performed, by the temperature decrease value Tpw attributable to an increased amount of fuel by the power boosting and the temperature decrease value Tsp proportional to the vehicle speed. Here, when the power boosting is not performed, the ECU 30 determines to execute OTP boosting when the normally estimated catalyst temperature Tkl is equal to or more than the predetermined setting value T1. When in the high load and high rotation operating condition, the ECU 30 puts the power boosting in execution and determines to execute OTP boosting when the estimated catalyst temperature Tkl estimated lower than the normal estimation is equal to or more than the predetermined setting value T1. Therefore, when the engine 1 comes into the high load and high rotation operating condition, after the power boosting is performed, the OTP boosting is performed when the estimated catalyst temperature Tkl estimated lower than the normal estimation is equal to or more than the predetermined setting value T1. The OTP boosting is performed later than normal, delayed from the start of the power boosting. This avoids that both power boosting and OTP boosting take effect at the same time longer than necessary. In consequence, it is possible to increase the fuel injection amount TAU by suitably combining the OTP boosting with the power boosting and prevent both exhaust emission of the engine 1 and fuel efficiency from being deteriorated.

Figure 8:
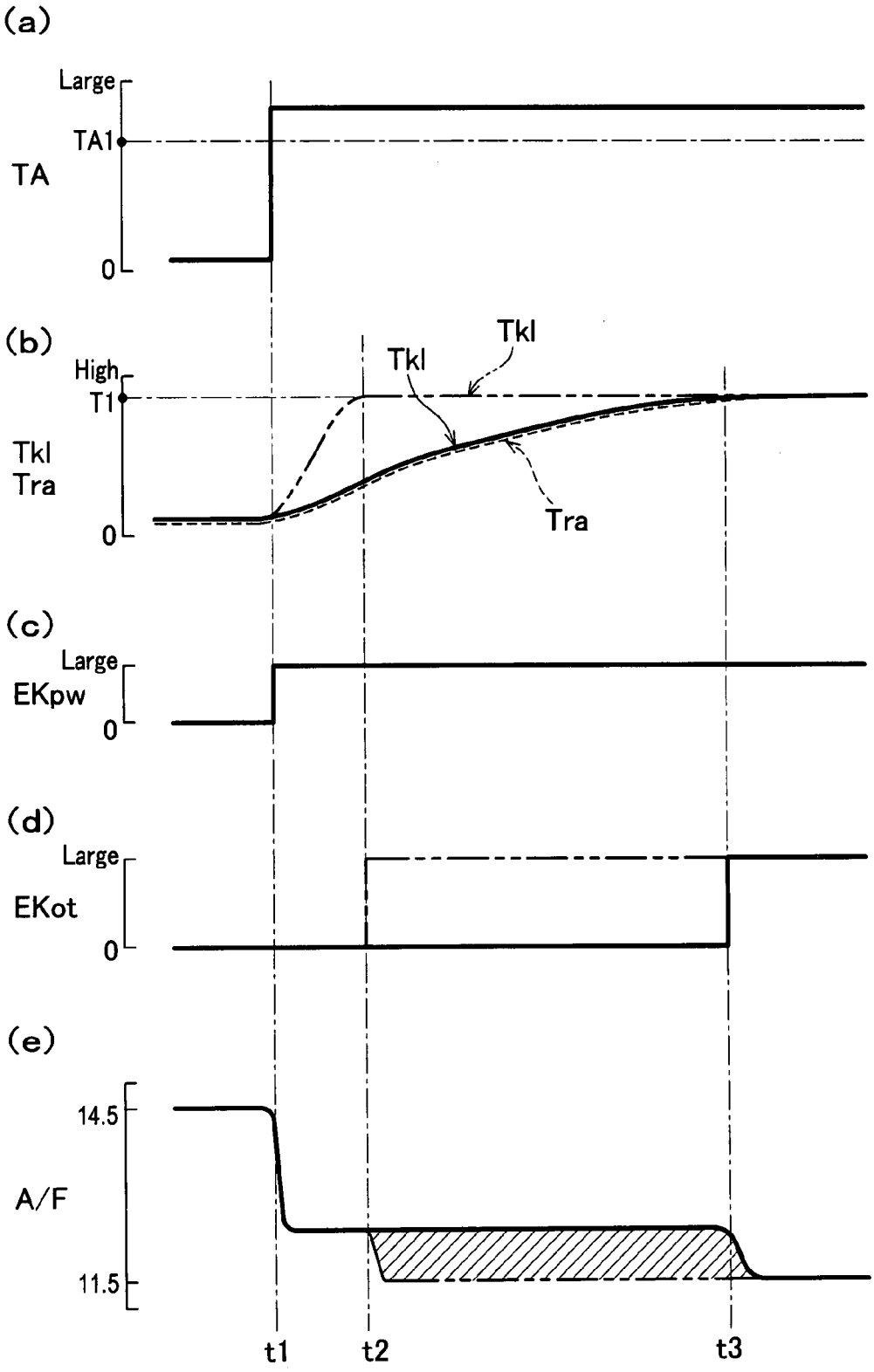
FIG. 8 is a timing charts showing one example of behaviors of various parameters.

Because the OTP boosting is performed when the estimated catalyst temperature Tkl estimated based on the operating condition of the engine 1 is equal to or more than the predetermined setting value T1, the timing to start the OTP boosting changes depending on the operating condition. Therefore, the OTP boosting can be performed at a proper timing for the operating condition of the engine 1. Here, an example of the behaviors of the respective parameters when the engine 1 comes into the high load and high rotation operating condition is shown in timing charts in FIG. 8. These timing charts represent the behaviors of the throttle opening degree TA, estimated catalyst temperature Tkl, actual catalyst temperature Tra, corrected power boost value EKpw, corrected OTP boost value EKot, and air-fuel ratio A/F.

During steady operation of the engine 1, when the throttle opening degree TA exceeds the criterion value TA1 by full-throttle acceleration at time t1, power boosting is started and the corrected power boost value EKpw is set to a predetermined value. Accordingly, the air-fuel ratio A/F is enriched quickly. At this time, because the power boosting is performed, the estimated catalyst temperature Tkl is estimated lower than when the power boosting is not performed. Thus, after time t1, the estimated catalyst temperature Tkl and the actual catalyst temperature Tra rise gradually. After that, when the estimated catalyst temperature Tkl reaches the setting value T1 at time t3, OTP boosting is started and the corrected OTP increase value EKot is set to a predetermined value. That is, after t3, both the power boosting and the OTP boosting are performed. In fact, it can be seen in FIG. 8 that, when the engine 1 comes into the high load and high rotation operating condition, the ECU 30 puts the power boosting in execution and determines to execute the OTP boosting later from the start of the power boosting, delayed by a period (from time t1 to time t3) attributable to an increased amount of fuel by the power boosting (the temperature decrease value Tpw) and attributable to the temperature decrease value (Tsp) proportional to the vehicle speed. The delay period before the start of the OTP boosting can be assumed to be, for example, on the order of "3 to 4 seconds".

In contrast, it is assumed that, under the above conditions, the estimated catalyst temperature Tkl is estimated as in the case where the power boosting is not performed, even though power boosting is performed. In this comparison example, as indicated by a two-dot chain line in FIG. 8, the estimated catalyst temperature Tkl rises relatively sharply from time t1 and exceeds the setting value T1 at a relatively early time immediately after the start of the power boosting and, at this time t2, the OTP boosting is started. Thereby, the air-fuel ratio A/F is enriched from time t2 and, accordingly, the period in which both the power boosting and the OTP boosting are performed in parallel becomes longer. As compared with the above comparison example, the fuel injection amount control apparatus of the present embodiment can therefore suppress over-enriching of the air-fuel ratio A/F as indicated by a shaded portion in FIG. 8(*e*). In that sense, it can be seen that exhaust emission and fuel efficiency can be prevented from being deteriorated.

From another view, when the engine 1 comes into the high load and high rotation operating condition, the ECU 30 puts power boosting in execution and determines to execute OTP boosting later from the start of the power boosting, delayed by a period attributable to an increased amount of fuel by the power boosting and attributable to a temperature decrease value proportional to the vehicle speed. Thus, when the engine 1 comes into the high load and high rotation operating condition, it is avoided that both power boosting and OTP boosting take effect at the same time longer than necessary. In this sense, it is also possible to increase the fuel injection amount TAU by suitably combining the OTP boosting with the power boosting and prevent deterioration in both exhaust emission of the engine 1 and fuel efficiency. Here, the OTP boosting is performed, delayed by a period attributable to an increased amount of fuel by the power boosting and attributable to a temperature decrease value proportional to the vehicle speed. In this relation, overheating of the exhaust system for the delay time may be of concern. However, the delay of the OTP boosting might not negatively impact overheating of the exhaust system, because the power boosting can also provide the effect of enriching the air-fuel ratio, thus decreasing the exhaust gas temperature and suppressing a temperature rise of the three-way catalyst 12, as described above.

In the present embodiment, when power boosting is performed, the estimated catalyst temperature Tkl is estimated at a lower temperature attributable to an increased amount of fuel by the power boosting, that is, lower by the temperature decrease value Tpw. In that sense, the delay time after the start of the power boosting until the OTP boosting is executed is adjusted appropriately. In this light, OTP boosting can be performed accurately and both exhaust emission of the engine 1 and fuel efficiency can accurately be prevented from being deteriorated.

In the present embodiment, when power boosting is performed, the estimated catalyst temperature Tkl is estimated at a lower temperature attributable to the vehicle speed SPD of the car, that is, lower by the temperature decrease value Tsp. In that sense, the delay time after the start of the power boosting until the OTP boosting is executed is adjusted appropriately. In this light, OTP boosting can be performed accurately and both exhaust emission of the engine 1 and fuel efficiency can accurately be prevented from being deteriorated.

The present invention may be embodied in other specific forms without departing from the essential characteristics thereof.

For instance, while the temperature decrease value Tsp attributable to the vehicle speed is taken into account in calculating the estimated catalyst temperature Tkl in the foregoing embodiment, this temperature decrease value Tsp corresponding to a temperature decrease value proportional to the vehicle speed may not be used and only the temperature decrease value Tpw attributable to an increased amount of fuel by the power boosting may be taken into account in calculating the estimated catalyst temperature Tkl.

What is claimed is:

1. A fuel injection amount control apparatus for internal combustion engine, including fuel injection amount control means arranged to control a fuel injection amount of fuel injection means to the internal combustion engine according to an operating condition of the internal combustion engine, perform OTP boosting that increases the fuel injection amount in order to prevent overheating of an exhaust system when the internal combustion engine comes into a first given operating condition, and execute power boosting that increases the fuel injection amount in order to enrich an air-fuel ratio to an output air-fuel ratio when the internal combustion engine comes into a second given operating condition, and wherein the apparatus includes boost timing adjustment means arranged to cause the injection amount control means to perform the power boosting and arranged to execute the OTP boosting later from start of the power boosting, delayed by a period attributable to at least an increased amount of fuel by the power boosting, when the internal combustion engine comes into the first given operating condition and the second given operating condition.

2. The fuel injection amount control apparatus for internal combustion engine according claim 1, wherein the first given operating condition is a condition that the internal combustion engine runs in high rotation under high load, and the second given operating condition is a condition that the internal combustion engine runs in low or medium rotation under high load.

3. A fuel injection amount control apparatus for internal combustion engine, including fuel injection amount control means arranged to control a fuel injection amount of fuel injection means to the internal combustion engine according to an operating condition of the internal combustion engine, perform OTP boosting that increases the fuel injection amount in order to prevent overheating of an exhaust system including a catalyst when the internal combustion engine comes into a first given operating condition, and execute power boosting that increases the fuel injection amount in order to enrich an air-fuel ratio to an output air-fuel ratio when the internal combustion engine comes into a second given operating condition, and wherein the apparatus includes:

temperature estimation means which estimates the temperature of the catalyst based on the operating condition of the internal combustion engine and, when the power boosting is performed, estimates the catalyst temperature lower than when the power boosting is not performed, the injection amount control means being arranged to perform the OTP boosting when the power boosting is not performed and the estimated catalyst temperature is equal to or more than a predetermined value, and boost timing adjustment means arranged to cause the injection amount control means, when the internal combustion engine comes into the first given operating condition and the second given operating condition, to perform power boosting and to execute OTP boosting when the catalyst temperature estimated lower is equal to or more than the predetermined value.

4. The fuel injection amount control apparatus for internal combustion engine according claim 3, wherein the first given operating condition is a condition that the internal combustion engine runs in high rotation under high load, and the second given operating condition is a condition that the internal combustion engine runs in low or medium rotation under high load.

5. The fuel injection amount control apparatus for internal combustion engine according claim 3, wherein the temperature estimation means estimates the catalyst temperature at a lower temperature attributable to at least an increased amount of fuel by the power boosting when the power boosting is performed.

6. The fuel injection amount control apparatus for internal combustion engine according claim 5, wherein the temperature estimation means performs a temperature decrease proportional to vehicle speed.

* * * * *